US011515080B2

(12) United States Patent
Ma et al.

(10) Patent No.: US 11,515,080 B2
(45) **Date of Patent: *Nov. 29, 2022**

(54) TRANSFORMER, COIL UNIT AND ELECTRONIC POWER APPARATUS

(71) Applicant: Delta Electronics (Shanghai) CO., LTD, Shanghai (CN)

(72) Inventors: Peng Ma, Shanghai (CN); Yicong Xie, Shanghai (CN); Quanliang Zhang, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 433 days.

This patent is subject to a terminal disclaimer.

(21) Appl. No.: 16/850,896

(22) Filed: Apr. 16, 2020

(65) Prior Publication Data

US 2020/0243253 A1 Jul. 30, 2020

Related U.S. Application Data

(63) Continuation-in-part of application No. 15/869,452, filed on Jan. 12, 2018, now Pat. No. 10,886,054.

(30) Foreign Application Priority Data

Jan. 25, 2017 (CN) ..... 201720104174.1
Apr. 26, 2019 (CN) ..... 201920590421.2

(51) Int. Cl.
*H01F 27/32* (2006.01)
*H01F 27/24* (2006.01)
(Continued)

(52) U.S. Cl.
CPC ..... *H01F 27/327* (2013.01); *H01F 27/24* (2013.01); *H01F 27/2885* (2013.01); *H01F 27/29* (2013.01); *H01F 41/127* (2013.01)

(58) Field of Classification Search
CPC .... H01F 27/327; H01F 27/24; H01F 27/2885; H01F 27/29; H01F 41/127; H01F 27/255
See application file for complete search history.

(56) References Cited

U.S. PATENT DOCUMENTS 4,459,575 A * 7/1984 Geissler ..... H01F 27/306 336/196
4,586,015 A * 4/1986 Takahara ..... H01F 27/363 336/69

(Continued)

FOREIGN PATENT DOCUMENTS

CN 201289787 Y 8/2009
CN 204010993 U * 12/2014

(Continued)

OTHER PUBLICATIONS

The Notice of Allowance dated Oct. 8, 2021 for U.S. Appl. No. 16/856,682.

(Continued)

*Primary Examiner* — Mang Tin Bik Lian
*Assistant Examiner* — Malcolm Barnes
(74) *Attorney, Agent, or Firm* — Qinghong Xu

(57) ABSTRACT

A transformer includes a primary coil unit including a primary winding, a first insulating portion and a shielding layer, wherein the first insulating portion wraps the primary winding, the shielding layer covers an outer surface of the first insulating portion, the shielding layer includes an opening, and a part of the first insulating portion is exposed at the opening; an outgoing wire terminal in the opening and having a first portion and a second portion connected with each other, the first portion coupled to the primary winding and wrapped by the first insulating portion, the second portion being exposed out of the first insulating portion; a connecting wire having a first end connected to the second portion of the outgoing wire terminal; and an insulating (Continued)

sleeve partially wrapping the connecting wire, and a second end of the connecting wire being exposed out of the insulating sleeve, (FIG. 17).

29 Claims, 23 Drawing Sheets

(51) Int. Cl.
*H01F 27/28* (2006.01)
*H01F 27/29* (2006.01)
*H01F 41/12* (2006.01)

(56) References Cited

U.S. PATENT DOCUMENTS

| | | | | |
|---|---|---|---|---|
| 4,660,014 | A | 4/1987 | Wenaas et al. | |
| 4,864,265 | A * | 9/1989 | Peoples | H01F 27/363 336/5 |
| 6,187,410 | B1 * | 2/2001 | Takahashi | B29C 45/1671 428/432 |
| 6,445,269 | B1 | 9/2002 | Sylvain et al. | |
| 9,640,314 | B2 | 5/2017 | Singh | |
| 2002/0057170 | A1 * | 5/2002 | Skinner | H01F 38/12 336/198 |
| 2002/0063617 | A1 * | 5/2002 | Hu | H01F 37/00 336/92 |
| 2003/0070664 | A1 * | 4/2003 | Skinner | H01F 27/255 123/634 |
| 2006/0200971 | A1 | 9/2006 | Lanoue et al. | |
| 2008/0211611 | A1 * | 9/2008 | Hanov | H01F 27/36 336/60 |
| 2010/0085775 | A1 | 4/2010 | Niess | |
| 2010/0127815 | A1 | 5/2010 | Damnjanovic | |
| 2010/0301981 | A1 | 12/2010 | Zeng et al. | |
| 2013/0113598 | A1 | 5/2013 | Murillo et al. | |
| 2013/0127580 | A1 | 5/2013 | Dobbs | |
| 2014/0118946 | A1 | 5/2014 | Tong et al. | |
| 2015/0028989 | A1 | 1/2015 | De Leon | |
| 2016/0155563 | A1 * | 6/2016 | Ballard | H01F 41/127 264/272.13 |
| 2019/0096567 | A1 | 3/2019 | Zhang | |
| 2020/0075218 | A1 | 3/2020 | Nah et al. | |

FOREIGN PATENT DOCUMENTS

| | | | | |
|---|---|---|---|---|
| CN | 204010993 | U | | 12/2014 |
| CN | 204946669 | U | * | 1/2016 |
| CN | 204946669 | U | | 1/2016 |
| CN | 206148257 | U | * | 5/2017 |
| CN | 206148257 | U | | 5/2017 |
| JP | S5882512 | A | | 5/1983 |
| JP | 59074614 | A | | 4/1984 |
| WO | 2015062838 | A1 | | 5/2015 |

OTHER PUBLICATIONS

The Non-final OA dated Feb. 21, 2020 by the USPTO.
The Non-final Office Action dated Feb. 28, 2022 for U.S. Appl. No. 16/197,784.
The USNOA dated Sep. 18, 2020 by the USPTO.

* cited by examiner

TRANSFORMER, COIL UNIT AND ELECTRONIC POWER APPARATUS

CROSS REFERENCE

This application is a Continuation-In-Part application of U.S. Ser. No. 15/869,452, with filing date of Jan. 12, 2018, which is based upon and claims priority to Chinese Patent Application No. 201720104174.1, filed on Jan. 25, 2017. This application claims priority to Chinese Patent Application No. 201920590421.2, filed on Apr. 26, 2019, the entire contents thereof are incorporated herein by reference.

TECHNICAL FIELD

The present disclosure relates to a coil unit, a transformer and an electronic power apparatus.

BACKGROUND

In an existing power distribution network, a high voltage, for example above 2 kV (kilovolt) in China, is subject to voltage decrease by means of a distribution transformer and then supplied to various loads for use. Therefore, in such a power distribution network, the distribution transformer is one of important parts. A traditional distribution transformer has many defects, for example, large size, heavy weight, great no-load loss, failed automatic isolation from fault, and susceptible to interference of power grid, etc.

At present, new technical solutions are sought in the industries. For example, a power electrode transformer (PET) is employed to replace a power frequency distribution transformer to remedy defects and implement high power density, miniaturization, high efficiency and intelligentization of a power distribution system. One core part of the PET is high-frequency high-voltage transformer, which is used for electrical energy conversion and electrical isolation between a high-voltage side and a low-voltage side.

Generally, the high-frequency high-voltage transformer is manufactured by the following three modes. In the first mode, the high-frequency high-voltage transformer may use air as main insulation against ground, which is similar to a power frequency dry-type transformer. However, larger insulation size is required because the insulation strength of air is relatively weak. The first mode is disadvantageous to the increase of power density. Also a high-voltage potential appears on the external surface of the transformer, so that it is required to take a safety distance into account. In the second mode, the high-frequency high-voltage transformer may use oil as main insulation against ground, which is similar to an oil-immersed transformer. However, in the second mode a shell and flammable insulating oil are required, and thus a potential safety hazard exists in an indoor environment. In the third mode, an integrated epoxy resin cast transformer is manufactured using a vacuum casting process, where a winding and a magnetic core are entirely cast into a resin. In case of an insulation fault, safety isolation is hard to make between the high-voltage side and the low-voltage side, and thus a potential safety hazard exists. Furthermore, a high voltage potential appears on the external surface of the transformer, so that it is required to take a safety distance into account, which is disadvantageous to the increase of power density.

Excellent outgoing-wire design can improve reliability of the transformer and make it more convenient to use the transformer. High-frequency and high-voltage transformers adopt solid insulation with shielding. The design of outgoing wire of the high-frequency and high-voltage transformers is important for both insulation and safety. Therefore, it is necessary to carry out special design of the outgoing wire of the transformer to meet the requirements of safety regulation and insulation strength within a small space.

The above-mentioned information disclosed in this Background section is only for the purpose of enhancing the understanding of background of the present disclosure and may therefore include information that does not constitute a prior art that is known to those of ordinary skill in the art.

SUMMARY

According to an aspect of the present disclosure, a transformer includes:

a primary coil unit comprising a primary winding, a first insulating portion and a shielding layer, wherein the first insulating portion is configured to wrap and fix the primary winding, the shielding layer covers an outer surface of the first insulating portion, the shielding layer includes an opening, and a part of the first insulating portion is exposed at the opening;

an outgoing wire terminal provided in the opening and having a first portion and a second portion, the first portion coupled to the primary winding and wrapped by the first insulating portion, and the second portion being exposed out of the first insulating portion, and the first portion and the second portion being connected with each other:

a connecting wire having a first end connected to the second portion of the outgoing wire terminal; and an insulating sleeve, partially wrapping the connecting wire, and a second end of the connecting wire being exposed out of the insulating sleeve.

The transformer and coil unit of the present disclosure are designed such that the connecting wire is connected with the outgoing wire terminal, and the insulating sleeve is partially wrapped, so that the distance from the second end of the connecting wire to the shielding layer can be ensured to meet the safety regulation by setting the length of the insulating sleeve. And, such structure that the connecting wire passes through the insulating sleeve has a better flexibility, and can be bent according to requirements, in order to reduce the occupied space volume of the transformer in the device and apply to the device with a limited space in the height direction.

According to another aspect of the present disclosure, a coil unit is provided, including:

a primary winding;

a first insulating portion wrapping and fixing the primary winding;

a shielding layer covering an outer surface of the first insulating portion and having an opening, a part of the first insulating portion being exposed at the opening;

an outgoing wire terminal provided in the opening and comprising a first portion and a second portion, wherein the first portion and the second portion are connected to each other, the first portion is coupled to the primary winding and is wrapped by the first insulating portion, and the second portion is exposed out of the first insulating portion:

a connecting wire having a first end connected to the second portion of the outgoing wire terminal; and an insulating sleeve wrapping the connecting wire, and a second end of the connecting wire being exposed out of the insulating sleeve.

According to another aspect of the present disclosure, there is provided a high-voltage transformer, which includes a magnetic core, at least a secondary coil unit, and at least a primary coil unit. The secondary coil unit includes at least one secondary winding; and the primary coil unit includes at least one primary winding and a first insulating portion. The first insulating portion forms at least one through hole. The at least one primary winding encircle at least one through hole and is wrapped by the first insulating portion and fixed in the first insulating portion. The magnetic core passes through at least one through hole. A shielding layer is formed on a surface of the first insulating portion, and the shielding layer is used for connecting a safety ground.

According to another aspect of the utility model, there is provided a high-voltage transformer, which includes at least a secondary coil unit and at least a primary coil unit. The secondary coil unit includes at least one secondary winding; and the primary coil unit includes at least one primary winding and a first insulating portion. The first insulating portion forms at least one through hole. The at least one primary winding encircle at least one through hole and is wrapped by the first insulating portion and fixed in the first insulating portion. A shielding layer is formed on a surface of the first insulating portion, and the shielding layer is used for connecting a safety ground.

According to another aspect of the present disclosure, there is provided an electronic power apparatus, which includes a high-voltage transformer. The high-voltage transformer includes a magnetic core, a secondary coil unit, and a primary coil unit. The secondary coil unit includes at least one secondary winding. The primary coil unit includes at least one primary winding and a first insulating portion. The first insulating portion forms at least one through hole. The at least one primary winding encircle at least one of the through hole and is wrapped by the first insulating portion and fixed in the first insulating portion. The magnetic core passes through at least one of the through hole. A shielding layer is formed on a surface of the first insulating portion, and the shielding layer is connected to a safety ground.

BRIEF DESCRIPTION OF THE DRAWINGS

The above and other features and advantages of the present disclosure will become more apparent from the detailed description of exemplary embodiments with reference to the drawings, in which.

DETAILED DESCRIPTION

Exemplary embodiments will be described more comprehensively by referring to accompanying drawings. However, the exemplary embodiments may be carried out in various manners, and shall not be interpreted as being limited to the embodiments set forth herein; instead, providing these embodiments will make the present disclosure more comprehensive and complete, and will fully convey the conception of the exemplary embodiments to those skilled in the art. Throughout the drawings, similar reference signs indicate the same or similar structures, and their detailed description will be omitted.

Figure 1:
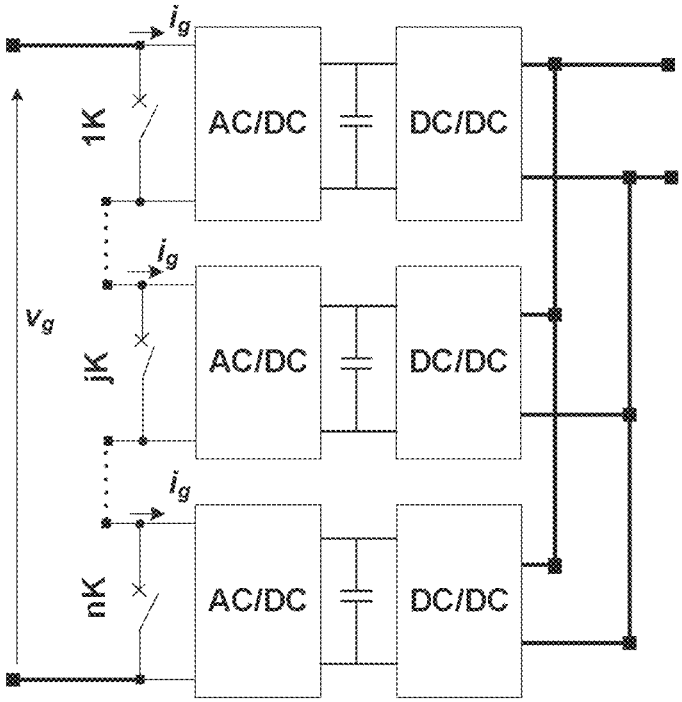
FIG. 1 is a circuit architecture diagram of a PET.
Figure 2:
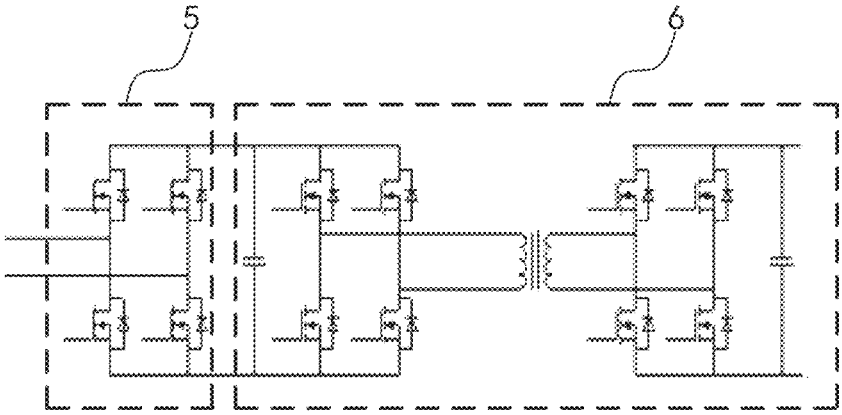
FIG. 2 is a schematic circuit diagram of a module in the circuit architecture diagram of the PET as shown in FIG. 1.

Reference is made to FIG. 1 and FIG. 2. As shown in FIG. 1, the PET is a multi-module input-series/output-parallel system architecture. The input current is marked as ig. Each module may include, for example, an AD/DC unit, a DC bus, and a DC/DC unit, which are sequentially connected. Bypass switches 1K to nK may be connected with the n modules. As shown in FIG. 2, the module includes cascade-connected AC/DC unit 5 and DC/DC unit 6. The DC/DC unit includes a core component, namely a high-frequency high-voltage transformer, which is used for electrical energy conversion and electrical isolation between a high voltage side and a low voltage side.

The High-Voltage Transformer According to the First Embodiment

Figure 3:
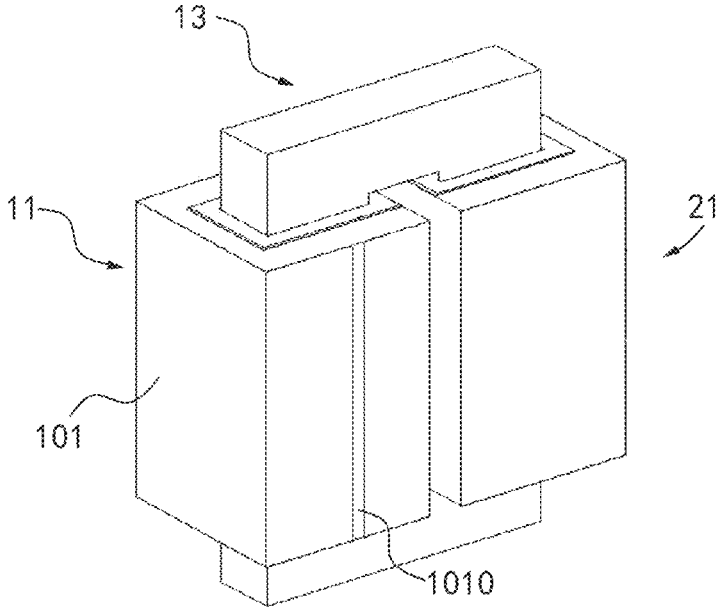
FIG. 3 is a perspective view of a high-voltage transformer according to a first embodiment of the present disclosure.
Figure 4:
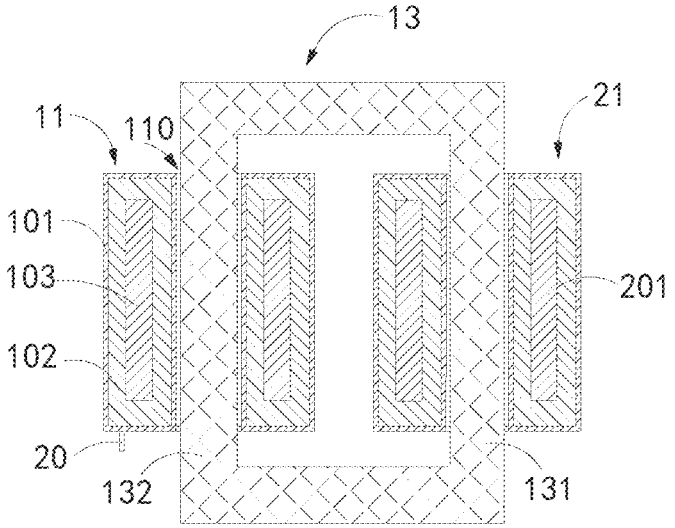
FIG. 4 is a cross-sectional view along the longitudinal direction of the high-voltage transformer as shown in FIG. 3.
Figure 5:
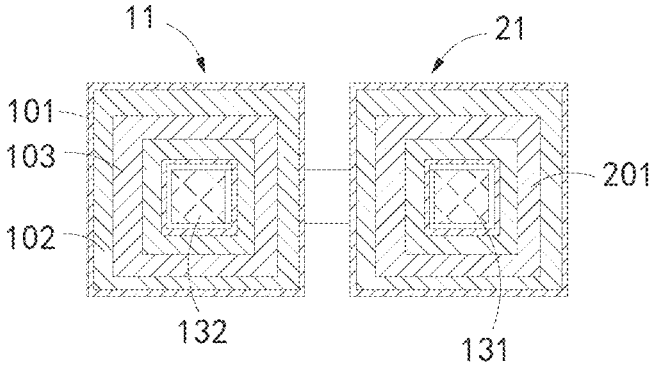
FIG. 5 is a cross-sectional view along the transversal direction of the high-voltage transformer as shown in FIG. 3.

Referring to FIG. 3, FIG. 4 and FIG. 5, FIG. 3 is a structural diagram of the high-voltage transformer according to the first embodiment of the present disclosure; FIG. 4 is a cross-sectional view along the longitudinal direction of the high-voltage transformer as shown in FIG. 3; and FIG. 5 is a cross-sectional view along the transversal direction of the high-voltage transformer as shown in FIG. 3. As shown in FIG. 3 to FIG. 5, the high-voltage transformer according to the first embodiment includes a primary coil unit 11, a secondary coil unit 21, and a magnetic core 13. The primary coil unit 11 includes a primary winding 103 and a first insulating portion 102.

The first insulating portion 102 may be made from an insulating material such as a resin, into which a through hole 110 is formed. In other embodiments, the number of the through hole 110 in the first insulating portion 102 is not limited to one, which may be two or even more. The through hole 110 is configured to be passed through by the magnetic core.

The primary winding 103 encircles the through hole 110 and is wrapped by the first insulating portion 102 and fixed in the first insulating portion 102. A shielding layer 101 is formed on a surface of the first insulating portion 102. A maximum voltage against ground of the primary coil unit 11 may be greater than 2 kV (kilovolt), for example, 3 kV, 6 kV, 10 kV, 20 kV, and so on. The first insulating portion is advantageous for designing voltage difference between the primary voltage and the secondary voltage. A ratio of the maximum voltage against ground of the primary coil unit 11 to a maximum voltage against ground of the secondary coil unit 21 may be not less than 5.

Figure 6:
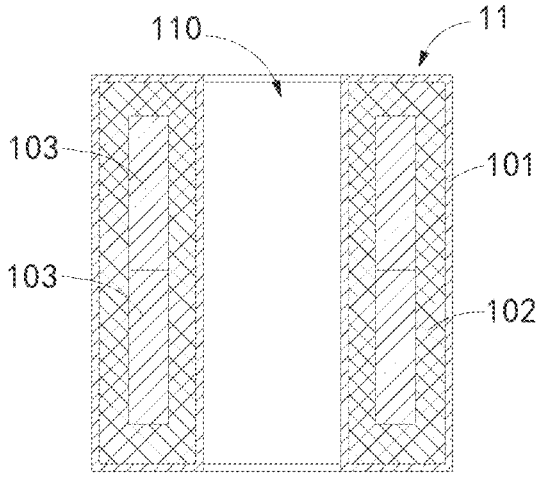
FIG. 6 is a cross-sectional view along the longitudinal direction of another structure of a primary winding in the high-voltage transformer as shown in FIG. 3.

Referring to FIG. 6, which is a cross-sectional view along the longitudinal direction of another structure of a primary winding unit in the high-voltage transformer as shown in FIG. 3, the primary coil unit 11 includes two series-connected primary windings 103. In the present disclosure, the number of the primary windings 103 in the primary coil unit 11 may be more than one, and a plurality of the primary windings 103 may be directly connected in parallel with each other, or directly connected in series with each other, or mutually independent and not directly connected with each other, but the present disclosure is not limited thereto.

The shielding layer 101 may cover all the surfaces of the first insulating portion 102, including an internal surface (the surface surrounding through hole) and an external surface and so on. The shielding layer 101 also may cover a part of the surfaces of the first insulating portion 102. Generally, to obtain a better shielding effect, the shielding layer 101 may cover more than 90% of the surface of the first insulating portion 102. The shielding layer 101 may be a copper foil, an aluminium foil, a zinc layer, a conductive silver lacquer layer, or a silver-copper alloy conductive lacquer layer and the like affixed to the surface of the first insulating portion 102, for example, an aluminium foil having a thickness of 0.2 mm or a zinc layer having a thickness of 18 um. The shielding layer 101 also may be a metal film such as a conductive gold film formed on the surface of the first insulating portion 102 by affixing, electroplating, evaporating, casting or spraying, etc. However, the present disclosure is not limited thereto.

The shielding layer 101 may be used for connecting a safety grounded point. The safety grounded point may be formed by, for example, a conductor buried into the ground, so as to reduce a high voltage potential of the primary coil unit and improve the safety performance of the high-voltage transformer. In some embodiments, for ease of connecting the safety ground, the shielding layer 101 is provided with a grounded terminal 20 (seeing FIG. 4). The grounded terminal 20 is used for connecting the shielding layer 101 to the safety ground in the form such as a surface-mounted grounded welding pad or a pin.

In some embodiments, the shielding layer 101 has a gap to prevent the shielding layer 101 from forming a closed conductive circuit. For example, the shielding layer 101 in FIG. 3 is provided with a gap 1010.

The secondary coil unit 21 may include at least one secondary winding 201, which may be directly connected in series with each other, or indirectly connected in series with each other, or directly connected in parallel with each other, or indirectly connected in parallel with each other, but the present disclosure is not limited thereto. In the first embodiment, the secondary coil unit 21 may be the same as the primary coil unit 11 in structure, including a secondary winding 201 which is fixed in and wrapped by an insulating material. The insulating material has a through hole, the secondary winding 201 encircles the through hole, and the insulating material may be entirely wrapped or partly covered with a shielding layer.

In the first embodiment, the magnetic core 13 includes a first column 131 and a second column 132. In other embodiments, the number of the column included in the magnetic core 13 is not limited to two. An air gap (not shown in the figure) may be arranged on the column or other positions the magnetic core 13. The number and position of the air gaps may be designed as needed.

The secondary coil unit 21 is arranged at the first column 131, that is, the first column 131 passes through the through hole of the secondary coil unit 21. The primary coil unit 11 is arranged at the second column 132, that is, the second column 132 passes through the through hole 110 of the primary coil unit 11.

In some embodiments, the primary coil unit 11 and/or the secondary coil unit 21 may be provided with pins passing through the shielding layer 101 for connecting the primary winding/secondary winding to other devices.

In the assembled high-voltage transformer, the primary coil unit 11, the secondary coil unit 21 and the magnetic core 13 may be exposed at air, so that heat dissipation mode is simplified, and heat dissipation effect is good.

In the first embodiment of the high-voltage transformer, the shielding layer 101 is electrically connected to the safety ground, so that a zero volt potential appears on the surface of the high-voltage transformer. Therefore, the safety performance is improved, and also other devices may be arranged nearby the primary coil unit 11, so that the high-voltage transformer is compact in structure, which is advantageous for enhancing power density and decreasing size. Furthermore, the high-voltage transformer also may be arranged nearby other devices, allowing the use to be more flexible and convenient.

The High-Voltage Transformer According to the Second Embodiment

Figure 7:
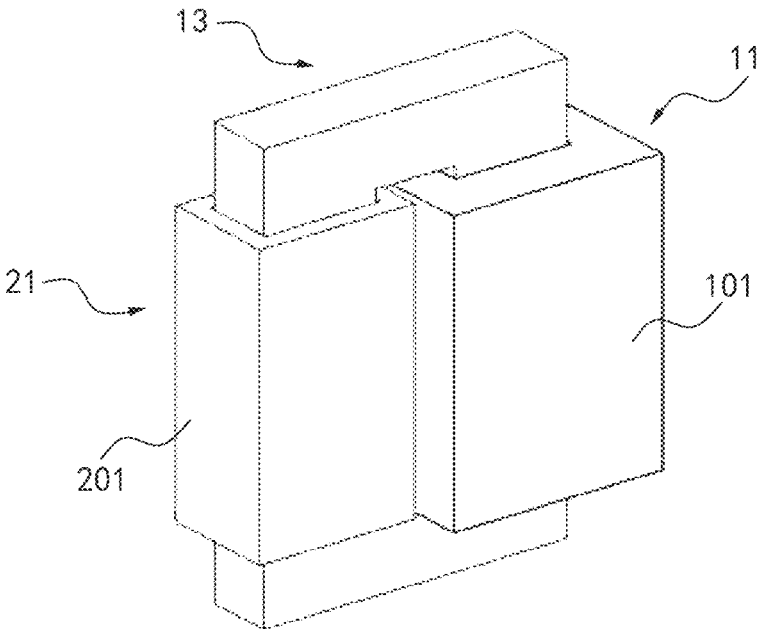
FIG. 7 is a structural diagram of a high-voltage transformer according to a second embodiment of the present disclosure.
Figure 8:
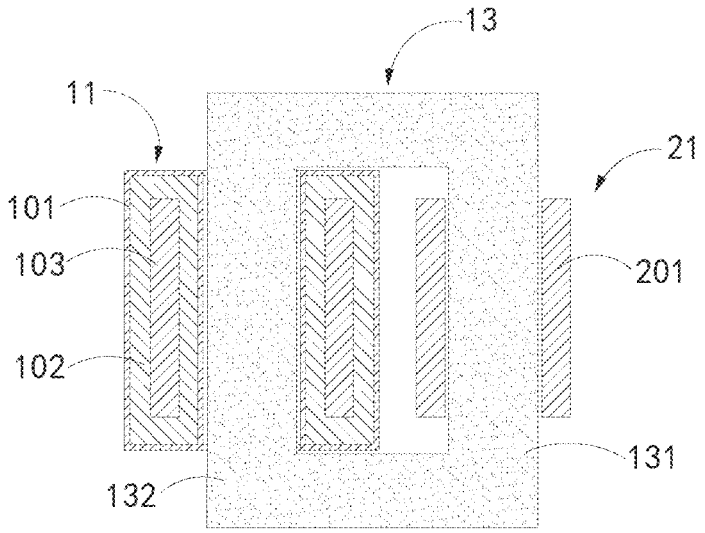
FIG. 8 is a cross-sectional view along the longitudinal direction of the high-voltage transformer as shown in FIG. 7.

Referring to FIG. 7 and FIG. 8, FIG. 7 is a structural diagram of the high-voltage transformer according to the second embodiment of the present disclosure; and FIG. 8 is a cross-sectional view along the longitudinal direction of the high-voltage transformer as shown in FIG. 7. As shown in FIG. 7 and FIG. 8, the difference between the high-voltage transformer according to the second embodiment and the high-voltage transformer according to the first embodiment mainly resides in that:

the secondary coil unit 21 may include a secondary winding 201 but not include the first insulating portion and the shielding layer. The secondary coil unit 21 generally is at a low voltage and thus is relatively safe. Furthermore, when the secondary coil unit 21 does not include the first insulating portion or the shielding layer, it is advantageous to enhancing power density and decreasing size of the high-voltage transformer. The size of the high-voltage transformer in this embodiment may be decreased to about 50% of that of a traditional high-voltage transformer.

Other structures of the high-voltage transformer according to the second embodiment are substantially the same as those of the high-voltage transformer according to the first embodiment, and thus their detailed descriptions are omitted herein.

The High-Voltage Transformer According to the Third Embodiment

Figure 9:
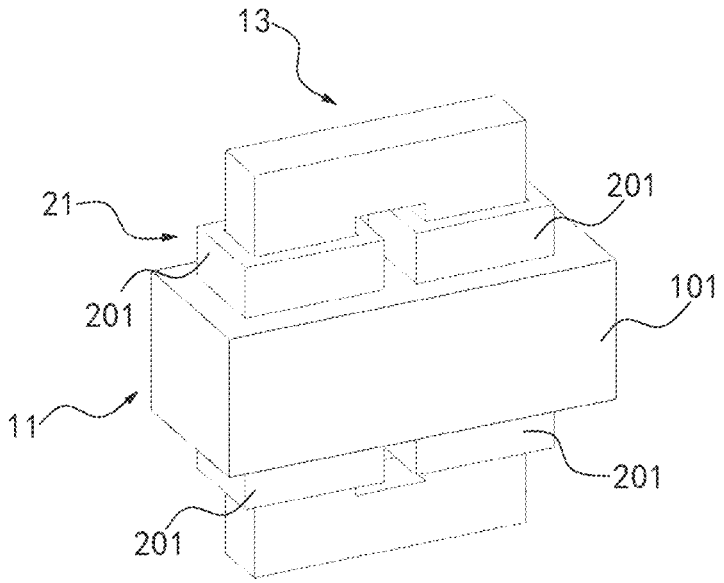
FIG. 9 is a structural diagram of a high-voltage transformer according to a third embodiment of the present disclosure.
Figure 10:
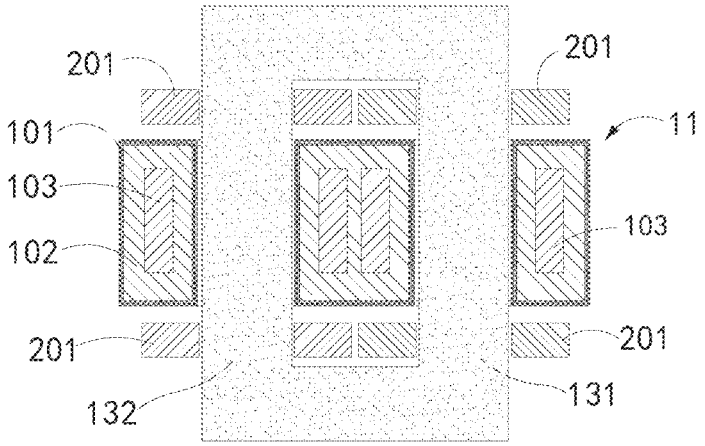
FIG. 10 is a cross-sectional view along the longitudinal direction of the high-voltage transformer as shown in FIG. 9.

Referring to FIG. 9 and FIG. 10, FIG. 9 is a structural diagram of the high-voltage transformer according to the third embodiment of the present disclosure; and FIG. 10 is a cross-sectional view along the longitudinal direction of the high-voltage transformer as shown in FIG. 9. As shown in FIG. 9 and FIG. 10, the difference between the high-voltage transformer according to the third embodiment and the high-voltage transformer according to the first embodiment mainly resides in that:

The primary coil unit 11 includes two through holes and two primary windings 103, where the two primary windings 103 in the first insulating portion may be physically independent and not connected. The first insulating portion 102 wraps and fixes the two primary windings 103 therein. The first insulating portion 102 forms the two through holes, and the two primary windings 103 respectively encircle the corresponding through holes. However, in other embodiments, the two primary windings 103 may encircle the same through hole, the present disclosure is not limited thereto.

The first column 131 and the second column 132 of the magnetic core 13 respectively pass through the corresponding through holes. The two primary windings 103 may further be connected in parallel or series by outer connections.

The secondary coil unit 21 may include four mutually independent secondary windings 201, but may not include the first insulating portion and the shielding layer. Two secondary windings 201 are wound around the first column 131 and positioned at two sides of the primary winding 103 of the primary coil unit, and a gap may be provided between the secondary winding 201 and the primary winding 103. The other two secondary windings 201 are wound around the second column 132 and positioned at two sides of the primary winding 103 of the primary coil unit, and a gap may be provided between the secondary winding 201 and the primary winding 103. A projection of the secondary winding 201 of the secondary coil unit on the magnetic core is not overlapped with that of the primary winding 103 of the primary coil unit on the magnetic core.

Figure 11:
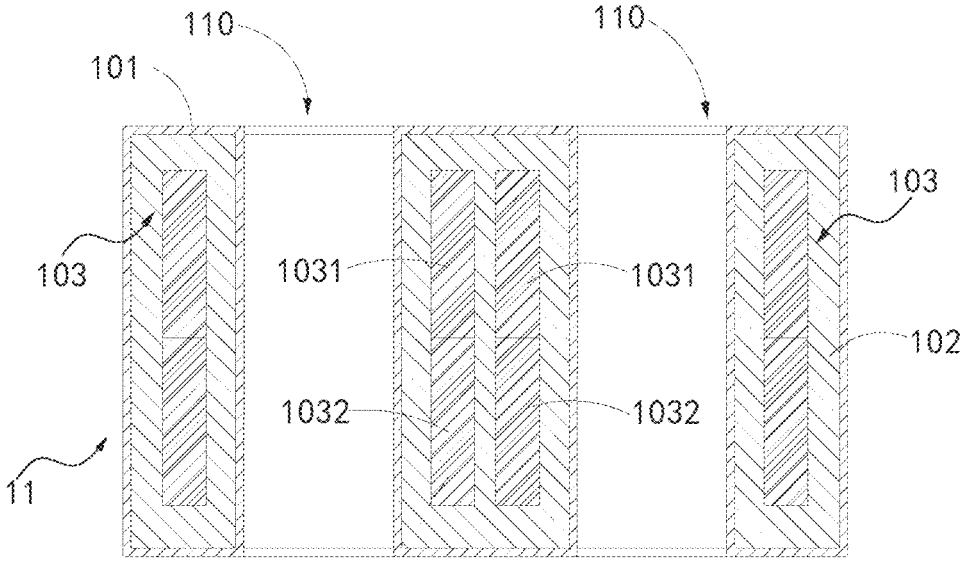
FIG. 11 is a cross-sectional view along the longitudinal direction of another structure of a primary winding in the high-voltage transformer as shown in FIG. 10.

The primary winding unit may have other structures. As shown in FIG. 11. FIG. 11 is a cross-sectional view along the longitudinal direction of another structure of a primary winding unit in the high-voltage transformer as shown in FIG. 10. As shown in FIG. 11, each of the primary windings 103 may further include two sub-windings 1031 and 1032 connected in series. Of course, the number of the sub-windings is not limited to two.

Other structures of the high-voltage transformer according to the third embodiment are substantially the same as those of the high-voltage transformer according to the first embodiment, and thus their detailed descriptions are omitted herein.

The High-voltage transformer according to the Fourth Embodiment

Figure 12:
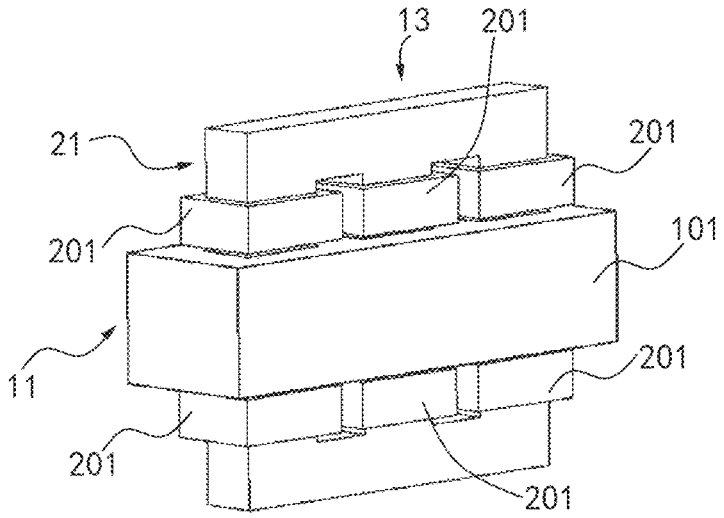
FIG. 12 is a structural diagram of a high-voltage transformer according to a fourth embodiment of the present disclosure.

Referring to FIG. 12, FIG. 12 is a structural diagram of the high-voltage transformer according to the fourth embodiment of the present disclosure. As shown in FIG. 12, the difference between the high-voltage transformer according to the fourth embodiment and the high-voltage transformer according to the third embodiment mainly resides in that:

the first insulating portion of the primary coil unit 11 has three through holes, the primary coil unit 11 includes three primary windings arranged respectively surrounding around the three through holes; the secondary coil unit 21 includes three pairs of mutually independent secondary windings (i.e. six secondary windings); and the magnetic core 13 includes three columns, each of the columns passes through one corresponding through hole of the primary coil unit 11 and a pair of secondary windings, and each pair of secondary windings are arranged at two sides of the primary winding.

Other structures of the high-voltage transformer according to the fourth embodiment are substantially the same as those of the high-voltage transformer according to the third embodiment, and thus their detailed descriptions are omitted herein.

The High-Voltage Transformer According to the Fifth Embodiment

Figure 13:
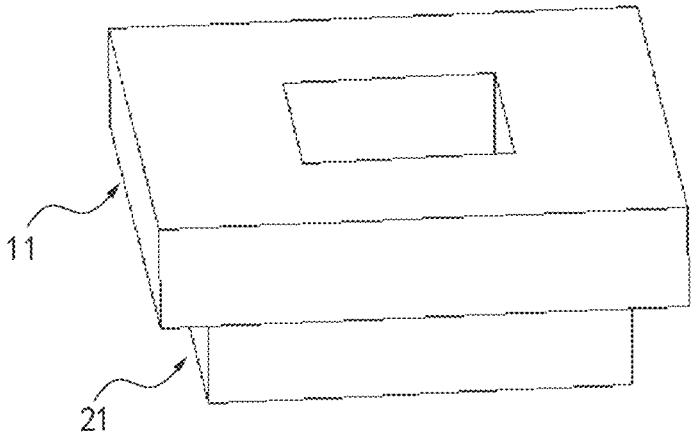
FIG. 13 is a structural diagram of the high-voltage transformer according to the fourth embodiment of the present disclosure.
Figure 14:
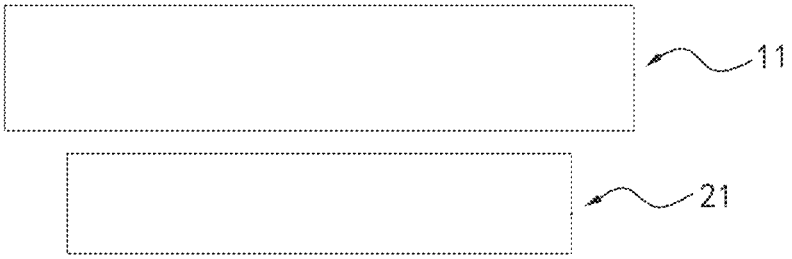
FIG. 14 is a front view of the high-voltage transformer as shown in FIG. 13.

Referring to FIG. 13 and FIG. 14, FIG. 13 is a structural diagram of the high-voltage transformer according to the fifth embodiment of the present disclosure; and FIG. 14 is a cross-sectional view along the longitudinal direction of the high-voltage transformer as shown in FIG. 13.

As shown in FIG. 13 and FIG. 14, the high-voltage transformer according to the fifth embodiment includes a primary coil unit 11 and a secondary coil unit 21. The primary coil unit 11 includes at least one primary winding 103 and a first insulating portion 102. The first insulating portion 102 forms at least one through hole 110, the at least one primary winding 103 encircle at least one of the through hole 110 and is wrapped by the first insulating portion 102 and fixed in the first insulating portion 102. The magnetic core 13 passes through at least one through hole 110. A shielding layer 101 is formed on the surface of the first insulating portion 102, and the shielding layer 101 is used for connecting a safety ground. The secondary coil unit 21 includes at least one secondary winding 201.

The primary coil unit 11 and the secondary coil unit 21 in the high-voltage transformer according to the fifth embodiment may be the same as those in the high-voltage transformer according to the foregoing embodiments. The high-voltage transformer according to the fifth embodiment does not include a magnetic core, and a magnetic field interlinks the primary winding and the secondary winding through air.

In the high-voltage transformer of the present disclosure, the primary winding of the primary coil unit is wrapped by the first insulating portion and fixed in the first insulating portion. That is, the first insulating portion plays roles in fixing and insulating the primary winding, which is advantageous to improving the safety performance of the high-voltage transformer. Further, a shielding layer is formed on the surface of the first insulating portion, and the shielding layer can be electrically connected to a safety ground, so that a high voltage potential of the primary coil unit is reduced, a low voltage potential or zero volt potential appears on the surface of the high-voltage transformer, and the safety performance of the high-voltage transformer is significantly improved. In another aspect, the low voltage potential or zero volt potential appears on the primary coil unit. Therefore, other parts such as the secondary coil unit or devices such as capacitors may be arranged nearby or even in direct contact with the primary coil unit, so that the power density can be significantly enhanced.

Electronic Power Apparatus

The electronic power apparatus of the present disclosure includes a high-voltage transformer. The high-voltage transformer includes a magnetic core, a primary coil unit, and a secondary coil unit. The secondary coil unit includes at least one secondary winding. The primary coil unit includes at least one primary winding and a first insulating portion. The first insulating portion forms at least one through hole. The at least one primary winding encircle the through hole and is wrapped by the first insulating portion and fixed in the first insulating portion. The magnetic core passes through at least one of the through hole. A shielding layer is formed on the surface of the first insulating portion, and the shielding layer is connected to a safety ground.

In some other embodiments, the electronic power apparatus also may not include the magnetic core.

The shielding layer is connected to a safety ground, which reduces the potential on the surface of the electronic power apparatus or even reduces the potential to zero, thereby greatly improving the safety performance.

At present, medium and high-voltage transformers generally have several methods for the outgoing wire:

1. Porcelain outgoing wires are the common outgoing wires for oil-immersed insulation products, which can meet the requirement of the withstand voltage of the product due to a strong insulation strength of the insulating oil. It is necessary that a length of the outgoing wire is greater than or equal to an electrical clearance thereof. For the solid main structure design, the porcelain outgoing wires cannot flexibly change the space position as desired during installation of the device. In this case, the transformer requires a larger space, so the overall power density of the product can be reduced. At the same time, due to requirement for filling oil, sealing and fire-fighting can also restrict the application of the products of such types.

Figure 15:
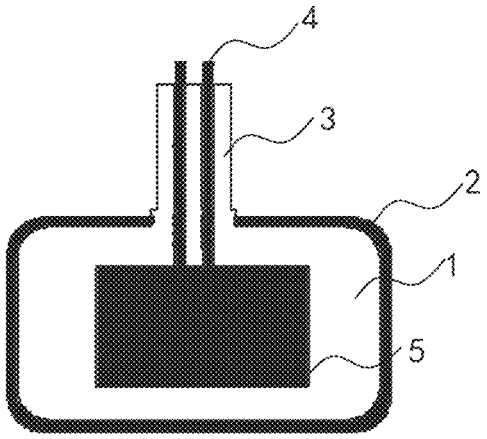
Fig.15 (Prior Art)
FIG. 15 is a schematic structural view of a transformer in a form of an integral epoxy column outgoing wire in the prior art.

2. In integrated epoxy column outgoing wire mode, outgoing wires are directly led out from the inside of the coil, and the external insulation of the epoxy outgoing wire column and the body insulation are integrally formed. As shown in FIG. 15, the outer side of part of the body insulation 1 is covered with grounding shielding layer 2. The outer insulation of the epoxy outgoing wire column 3 and the body insulation 1 are integrally formed. The outgoing wire 4 is directly led out of the epoxy outgoing wire column 3 from the inside of the coil 5. The grounding shielding layer 2 makes the electric field only exist in the solid insulation, thus increasing the operation stability of high-voltage products. At the same time, people can directly touch the grounding shielding layer, thus increasing personal safety protection. This kind of product uses the high insulation strength of solid insulation to meet the overall insulation requirements of the product, and avoids the interface defects between joints and different insulation media inside, thus better meeting the insulation performance requirements. However, similar to the porcelain insulator outgoing wire, the length of the epoxy column 3 needs to be greater than or equal to the electrical clearance specified by the safety regulations. Because the epoxy outgoing wire column is a pure solid structure and is integrally formed with the body insulation 1, the position of the occupied space cannot be flexibly changed according to the space requirement of the equipment during the installation of the equipment. This results in larger occupied volume of the transformer and lower overall power density of the product.

Figure 16A:
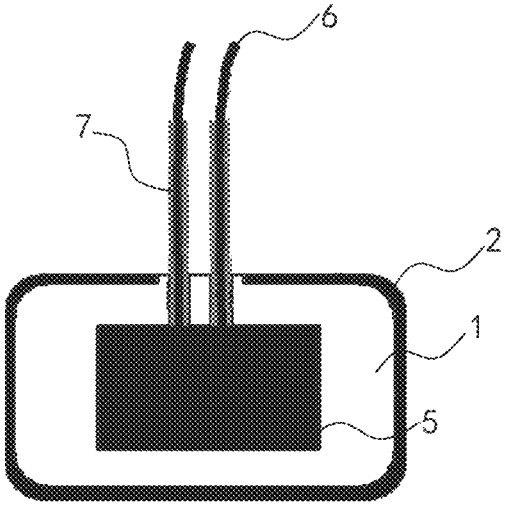
Fig.16a (Prior Art)
FIGS. 16*a* and 16*b* are schematic structural views of a transformer in a form of silica gel wire outgoing wire in the prior art.
Figure 16B:
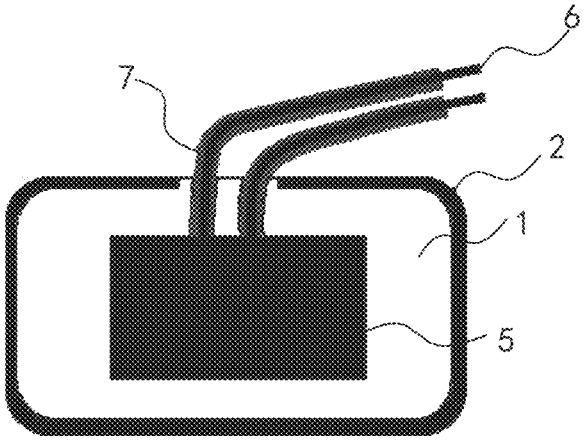
Fig.16b (Prior Art)

3. In order to increase the flexibility of transformer outgoing wire and reduce the occupied volume of transformer, the prior art adopts silicon gel wire (core wire is multi-strand wire) to replace the above-mentioned integrated epoxy columnar outgoing wire structure. As shown in FIG. 16*a*, the silicon gel core wire 6 is used as the outgoing wire, and the outer part thereof is coated with the silica gel wire insulation layer 7. The silicon gel wire is directly led out from the body insulation 1, as shown in FIG. 16*a*. As the silicon gel wire insulation layer has high insulation strength, it can meet the requirements of the insulation strength to ground of the product.

However, due to technological limitations, the diameter of multi-strand core wires in silicon gel wires is relatively large. Currently, there is no silicon gel wire product suitable for high-frequency (e.g., 200 kHz) situation on the market. Due to the large diameter of the core wire, the skin effect is serious at high frequencies (such as 200 kHz) and the loss of silicon gel wire is high, thus reducing the overall efficiency of the transformer.

The present disclosure further provides a transformer and a coil unit, which can meet the requirements of safety regulations and insulation strength in a space as small as possible.

Figure 17:
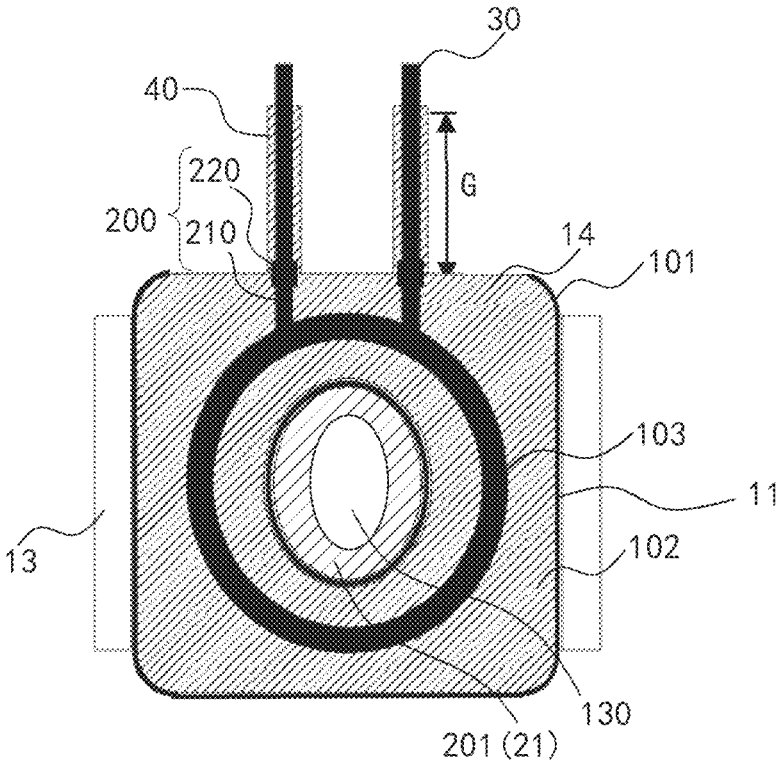
FIG. 17 is a schematic cross-sectional structural view of the transformer according to the first embodiment of the present disclosure.
Figure 18:
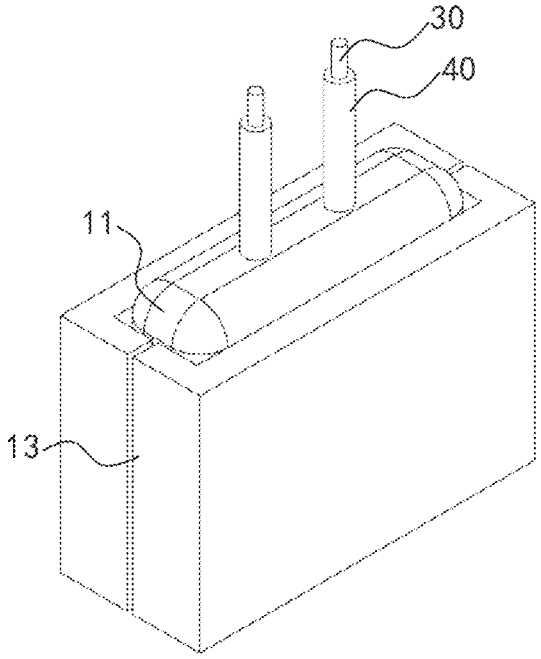
FIG. 18 is a perspective structural view of the transformer according to the first embodiment of the present disclosure.
Figure 19:
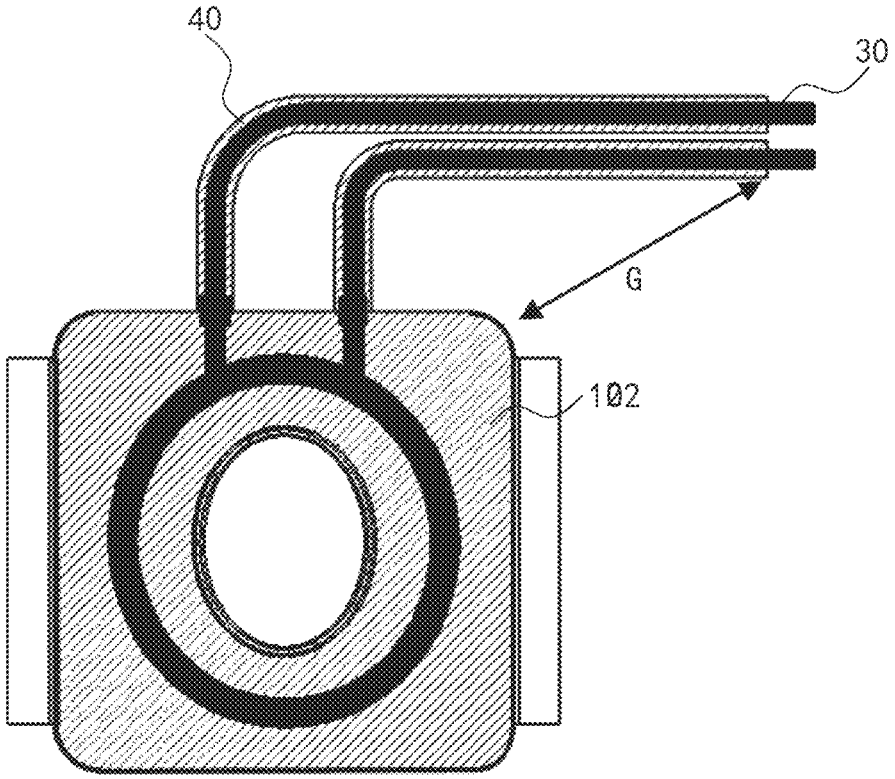
FIG. 19 is a schematic cross-sectional structural view of the transformer according to the first embodiment of the present disclosure, wherein the connecting wire extends to one side in a horizontal direction.

As shown in FIGS. 17 to 19, one aspect of the present disclosure provides a transformer, which includes a primary coil unit 11, an outgoing terminal 200, a connecting wire 30 and an insulating sleeve 40. The primary coil unit 11 includes a primary winding 103, a first insulating portion 102, and a shielding layer 101. The first insulating portion 102 wraps and fixes the primary winding 103. The shielding layer 101 covers the outer surface of the first insulating portion 102 and has an opening 14 at which a part of the first insulating portion 102 is exposed. The outgoing wire terminal 200 is arranged in the opening 14, and includes a first portion 210 coupled to the primary winding 103 and covered by the first insulating portion 102, and a second portion 220 being exposed out of the first insulating portion 102. The connecting wire 30 is connected to the outgoing wire terminal 200 and has a first end connected to the second portion 220 of the outgoing wire terminal 200. It should be noted that the second portion may be a convex portion higher than the outer surface of the first insulating portion 102, or a concave portion lower than the outer surface of the first insulating portion 102, as long as being exposed out of the first insulating portion. The second portion and the first portion may be integral structure or may be composed of discrete components. The insulating sleeve 40 wraps a part of the connecting wire 30, and the second end of the connecting wire 30 is exposed out of the insulating sleeve 40. The primary coil unit 11 may include one or more primary windings 103. Number of the outgoing wire terminals may be set according to connection mode and outgoing mode of the primary windings 103.

The transformer of the present disclosure is designed such that the connecting wire 30 is connected with the outgoing wire terminal 200, and the insulating sleeve 40 is partially wrapped. Therefore, a distance from the second end of the connecting wire 30 to the shielding layer 101 can be ensured to meet the safety regulation by setting the length of the insulating sleeve 40. And, such structure that the connecting wire passes through the insulating sleeve has a better flexibility and can be bent according to requirements, in order to reduce the occupied space volume of the transformer in the device. As shown in FIG. 19, the connecting wire 30 can extend to one side in the horizontal direction, which may reduce the height of the outgoing wire, only need to ensure the distance G between the second end of the connecting wire 30 and the shielding layer 101 to meet the safety requirements, so as to adapt to the device with limited space in the height direction. In addition, since it is not necessary to directly pour the insulating sleeve 40 into the first insulating portion 102, a risk of material leakage during the pouring process can be eliminated.

In this embodiment, the shielding layer 101 may be a copper foil, an aluminum foil, a zinc layer, a silver conductive paint layer or a silver copper alloy conductive paint layer attached to the surface of the first insulating portion 102, for example, an aluminum foil having a thickness of 0.2 mm or a zinc layer having a thickness of 18 um. The shielding layer 101 may also be a metal film such as a conductive gold film formed on the surface of the first insulating portion 102 by processes, such as pasting, electroplating, evaporation, pouring or sputtering, which is not limited thereto.

In this embodiment, the connecting wire 30 is a high-frequency conductive wire, which has a quite small core wire diameter and a weaker skin effect, to facilitate reducing transformer loss and improving the overall efficiency. Preferably, a relationship between a cross-sectional area S ($mm^2$) of the high-frequency conductive wire and an operating current I(A) of the transformer meets following condition: $S=I/4\ mm^2$. That is, the cross-sectional area of the high-frequency conductive wire is determined by the current that passes through the wire. The high-frequency conductive wire is a multi-strand wire, and the relationship between the diameter d (mm) of the multi-strand wire and the working frequency f(Hz) of the transformer meets the following condition: $d<152/(f)^{0.5}$ mm.

In this embodiment, the insulating sleeve 40 also wraps the second portion 220 of the outgoing wire terminal 200 and is closely connected to the first insulating portion 102. For example, the insulating sleeve 40 and the first insulating portion 102 are closely attached to one another to further ensure that the connecting wire 30 satisfies the safety requirement.

Wherein, both the insulating sleeve 40 and the connecting wire 30 may be flexible and more suitable for bending, so that the height of the outgoing wire can be reduced to be suitable for the device with a limited space in the height direction.

Wherein, the insulating sleeve 40 and the connecting wire 30 can be closely attached to one another, so that the outer diameter can be reduced. The insulating sleeve 40 may be an insulating tape or an insulating tube or the like that wraps the outer periphery of the connecting wire 30.

In this embodiment, the first end of the connecting wire 30 is connected to the second portion 220 of the outgoing wire terminal 200 by a bolt. However, the connecting mode between the connecting wire 30 and the outgoing wire terminal 200 is not limited, and any conventional connecting methods, such as a solder joint connection may be employed.

In this embodiment, as shown in FIG. 17, the transformer has a magnetic core 13, the magnetic core 13 has a core column 130, the first insulating portion 102 of the primary coil unit 11 forms a through hole 110, the core column 130 penetrates through the through hole 110, and the primary winding 103 is wound around the core column 130. The shielding layer 101 covers the inner and outer surfaces of the first insulating portion 102, and the shielding layer 101 is connected to the ground when used. In addition, the transformer further has a secondary coil unit 21. The second coil unit 21 has a secondary winding 201 that is directly wound on the core column 113, and is located between the shielding layer and the core column 113. In the other embodiments, the secondary coil unit may have the same structure as the primary winding unit, i.e., the secondary winding 201 is wrapped and fixed by an insulating material.

It should be noted that the present disclosure does not limit the combination between the magnetic core and the coil unit. For example, the secondary coil unit 21 may be superposed on the primary coil unit 11, or the secondary coil unit 50 and the primary coil unit 11 may be respectively located on different core columns of the magnetic core.

Further, the transformer is a high-frequency and high-voltage transformer, the primary winding 103 is a high-voltage side winding of the high-frequency and high-voltage transformer, the secondary winding 201 is a low-voltage side winding of the high-frequency and high-voltage transformer, and the insulating sleeve 40 is a high-voltage insulating sleeve or a high-voltage insulating tape. Wherein, the transformer has an operation frequency above 6 kHz and a high-voltage side voltage above 2 kV. However, the types of the transformers are not limited thereto. The structures, such as the connecting wire 30, the outgoing wire terminal 200, the insulating sleeve 40 included in the present disclosure can be applied to any other existing transformers, and the other structures can be added to the transformers as desired.

Figure 20:
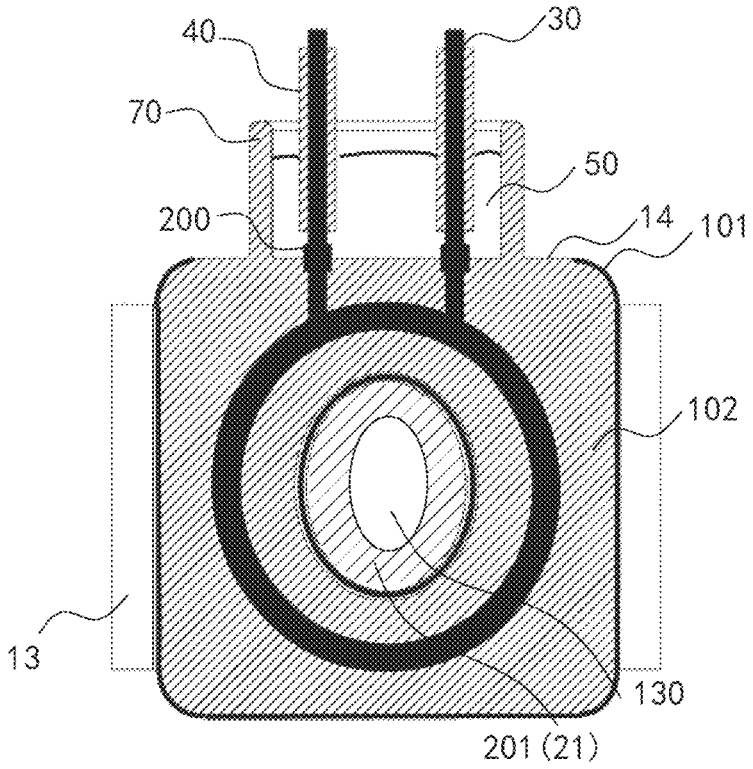
FIG. 20 is a schematic cross-sectional structural view of the transformer according to the second embodiment of the present disclosure.
Figure 21:
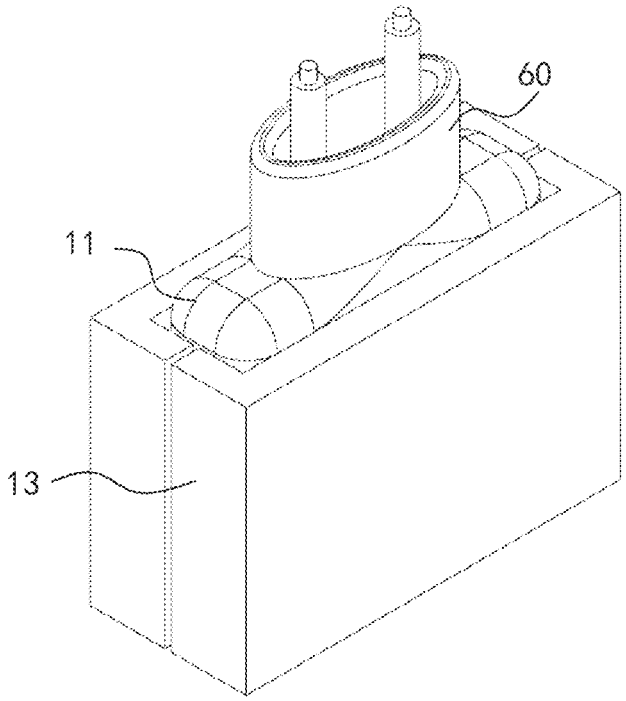
FIG. 21 is a perspective structural view of the transformer according to the second embodiment of the present disclosure.

The embodiment as shown in FIGS. 20 and 21 is mainly different from the embodiment as shown in FIG. 17 in that a second insulating portion 50 is further provided. Hereinafter, only the differences will be described, and the same portions will not be repeated.

In this embodiment, the second insulating portion 50 extends from the surface of the first insulating portion 102 exposed at the opening 14 to a direction away from the opening 14, and wraps a part of the insulating sleeve 40 and the second portion 220 of the outgoing wire terminal 200.

In this embodiment, the second insulating portion 50 is a potting layer. The potting layer may be made of polyurethane, silicon rubber or epoxy resin.

In this embodiment, the transformer may further include an insulating retaining wall 70, which extends from the surface of the first insulating portion 102 exposed at the opening 14 to a position which is higher than one end of the insulating sleeve close to the first insulation portion. The insulating retaining wall 70 surrounds the outgoing terminal 200 and the insulating sleeve 40. Preferably, the insulating retaining wall 70 may be integrally formed with the first insulating portion 102.

The other end of the insulating sleeve 40 extends out of the insulating retaining wall 70, such that the second end of the connecting wire 30 is exposed out of the insulating retaining wall 70 to connect to the external circuit.

Further, in this embodiment, the second insulating portion 50 is formed by potting the insulating material into a recess formed in the insulating retaining wall 70, so that a partial discharge voltage level of the connecting terminal can be increased, the service life of the transformer can be prolonged, anti-pollution and moisture-proof performance of the transformer can be improved, and the stability of the transformer can be enhanced. In addition, it is not necessary to separately design a potting mold for the second insulating portion 50, to avoid possibility of the material leakage due to a gap between the potting mold and the first insulating portion 102, and facilitate manufacturing, and reduce the cost.

In this embodiment, the second insulating portion 50 may include a lower insulating layer and an upper supporting layer, and a hardness of the upper supporting layer is greater than a hardness of the lower insulating layer. The lower insulating layer is closely connected with the first insulating portion 102 and extends to one end of the insulating sleeve 40 close to the first insulating portion 102, to wrap the second portion 220 of the outgoing wire terminal 200 and the portion in the first end of the connecting wire 30, which is exposed out of the insulating sleeve 40, and thereby playing a major insulating function. And, the lower insulating layer has a good filling capability for the air gap, which can improve the insulating performance of the outgoing wire terminal 200. The upper supporting layer is closely connected with the lower insulating layer and wraps a part of the insulating sleeve 40. The upper supporting layer has a greater hardness, and thus plays a role of fixing and supporting the connecting wire 30 and the insulating sleeve 40. For example, the lower insulating layer is a silicon rubber having lower hardness, and the upper insulating layer is a silicon rubber with higher hardness.

In this embodiment, in order to enhance a bonding force between the second insulating portion 50 and the insulating sleeve 40 or the insulating retaining wall 70, the surface of the insulating sleeve 40 or the insulating retaining wall 70 may be pretreated before filling the second insulating portion 50. For the insulating retaining wall 70, the surface roughness is increased by blasting sand on the surface, and then is coated with a coupling agent (such as gamma-aminopropyltriethoxysilane, etc.). The surface of the insulating sleeve 40 can be polished or treated with low-temperature plasma.

In other embodiments, the second insulating portion 50 and the insulating retaining wall 70 may be arranged alternatively. For example, only the second insulating portion 50 may be provided. The second insulating portion 50 may be a potting layer as shown in FIG. 20, or a convex structure as shown in FIG. 22.

Figure 22:
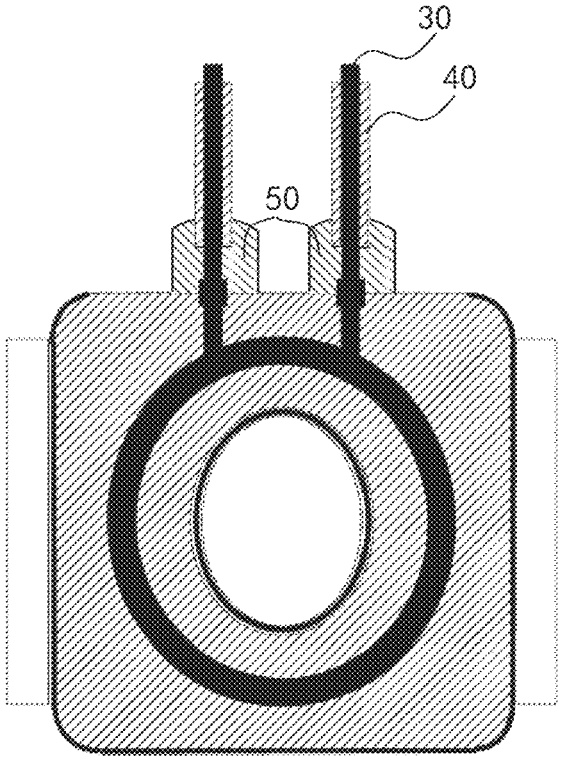
FIG. 22 is a schematic cross-sectional structural view of the transformer according to another embodiment of the present disclosure.

FIG. 22 is a schematic cross-sectional structural view of a transformer according to another embodiment of the present disclosure. An air gap may exist between the first insulating portion 102 and the high-voltage insulating sleeve 40. The surface of the insulating sleeve 40 and the first insulating portion 102 may be partially encapsulated by using an insulation glue or an insulation paint, such that second insulating portion 50 may be formed. The second insulating portion 50 wraps the second portion of the outgoing wire terminal and a part of the insulating sleeve 40, such that a good connection between the first insulating portion 102 and the insulating sleeve 40 can be formed and the partial discharge voltage level of the terminal can be improved. In order to ensure sufficient insulation strength, the insulation glue or the insulation paint can be higher than the connection interface between the first insulating portion 102 and the insulating sleeve 40.

In other embodiments, only the insulating retaining wall 70 may be provided, and the insulating retaining wall 70 does not contain the second insulating portion 50. The arrangement of the insulating retaining wall 70 may facilitate that the distance from the second end of the connecting wire 30 from the shielding layer 101 meets the safety requirements.

According to another aspect of the present disclosure, a coil unit is further provided, wherein the coil unit may be the primary coil unit 11 as shown in FIGS. 17 to 22. The coil unit includes a primary winding 103, a first insulating portion 102 and a shielding layer 101, wherein the first insulating portion 102 wraps and fixes the primary winding 103, the shielding layer 101 covers the outer surface of the first insulating portion 102 and has an opening 14, and a part of the first insulating portion 102 is exposed at the opening 14.

An outgoing wire structure includes an outgoing wire terminal 200, a connecting wire 30 and an insulating sleeve 40. The outgoing wire terminal 200 is provided in the opening 14; and includes a first portion 210 coupled to the primary winding 103 and wrapped by the first insulating portion 102, and a second portion 220 that is exposed out of the first insulating portion 102. The connecting wire 30 is connected to the outgoing wire terminal 200, and the first end of the connecting wire 30 is connected to the second portion 220 of the outgoing wire terminal 200. The insulating sleeve 40 wraps the connecting wire 30, and the second end of the connecting wire 30 is exposed out of the insulating sleeve 40.

It should be understood that the above-mentioned structures in the embodiments may employ the forms as illustrated in the previous embodiments.

As above described, the transformer and coil unit of the present disclosure are designed such that the connecting wire is connected with the outgoing wire terminal, and the insulating sleeve is partially wrapped, so that the distance from the second end of the connecting wire to the shielding layer can be ensured to meet the safety regulation by setting the length of the insulating sleeve. And, such structure that the connecting wire passes through the insulating sleeve has a better flexibility and can be bent according to requirements, in order to reduce the occupied space volume of the transformer in the device and is suitable for the device with a limited space in the height direction.

Relative terms such as "above" or "below" and "front" or "back" may be used in the above embodiments to describe a relative relation between one component and another component of an icon. It is to be understood that when the apparatus of the icon are turned upside down, components described as "above" or "below" and "front" or "back" will become components described as "below" or "above" and "back" or "front". The articles "a", "an", "the", and "at least one" are intended to mean that there are one or more element(s)/constituent part(s)/etc. The terms "comprising", "including" and "having" are intended to be inclusive and mean that there may be additional constituent part(s)/etc. other than the listed constituent part(s). Moreover, the terms "first" and "second" are used merely as labels, and are not intended to impose numerical requirements on their objects.

It is to be understood that the present disclosure is not limited in its application to the details of construction and the arrangement of the components set forth herein. The present disclosure may have other embodiments and can be implemented and carried out in various ways. Variations and modifications of the foregoing are within the scope of the present disclosure. It should be understood that the present disclosure disclosed and defined herein extends to all alternative combinations of two or more of the individual features mentioned or evident from the text and/or drawings. All of these different combinations constitute various alternative aspects of the present disclosure. The embodiments described herein explain the best modes known for practicing the present disclosure and will enable those skilled in the art to utilize the present disclosure.

What is claimed is:

1. A transformer comprising:

a primary coil unit comprising a primary winding, a first insulating portion and a shielding layer, wherein the first insulating portion is configured to wrap and fix the primary winding, the shielding layer covers an outer surface of the first insulating portion, the shielding layer includes an opening, and a part of the first insulating portion is exposed at the opening;

an outgoing wire terminal provided in the opening and having a first portion and a second portion, the first portion coupled to the primary winding and wrapped by the first insulating portion, and the second portion being exposed out of the first insulating portion, and the first portion and the second portion being connected with each other;

a connecting wire having a first end connected to the second portion of the outgoing wire terminal;

an insulating sleeve, partially wrapping the connecting wire, and a second end of the connecting wire being exposed out of the insulating sleeve, and an insulating retaining wall extending from the surface of the first insulating portion exposed at the opening to a position higher than an end of the insulating sleeve near the first insulating portion and surrounding the outgoing terminal and the insulating sleeve.

2. The transformer according to claim 1, wherein the insulating sleeve further wraps the second portion of the outgoing terminal and is closely connected to the first insulating portion.

3. The transformer according to claim 1, further comprising:

a second insulating portion, extending from a surface of the first insulating portion exposed at the opening to a direction away from the opening and wraps a part of the insulating sleeve and the second portion of the outgoing wire terminal.

4. The transformer according to claim 1, wherein both the insulating sleeve and the connecting wire are flexible.

5. The transformer according to claim 1, wherein the insulating sleeve is closely attached to the connecting wire.

6. The transformer according to claim 1, wherein the insulating sleeve is an insulating tape or an insulating tube wrapping around a periphery of the connecting wire.

7. The transformer according to claim 1, wherein the first insulating portion is made of an epoxy resin, a silicon rubber or a polyurethane.

8. The transformer according to claim 3, wherein the second insulating portion is made of an insulating glue or an insulating paint.

9. The transformer according to claim 2, wherein the first end of the connecting wire and the second portion of the outgoing wire terminal are connected by bolts or by solder joints.

10. The transformer according to claim 1, wherein the other end of the insulating sleeve extends out of the insulating retaining wall and the second end of the connecting wire is exposed out of the insulating retaining wall.

11. The transformer according to claim 3, wherein the second insulating portion is a potting layer.

12. The transformer according to claim 11, wherein the potting layer comprises:

a lower insulating layer closely connected to the first insulating portion and extending to one end of the insulating sleeve close to the first insulating portion, wherein the lower insulating layer is configured to wrap the second portion of the outgoing wire terminal and a portion of the first end of the connecting wire being exposed out of the insulating sleeve; and an upper supporting layer closely connected to the lower insulating layer and wrapping a part of the insulating sleeve;

wherein a hardness of the upper supporting layer is greater than a hardness of the lower insulating layer.

13. The transformer according to claim 1, wherein the transformer is a high-frequency and high-voltage transformer, and the connecting wire is a high-frequency conductive wire.

14. The transformer according to claim 13, wherein the high-frequency conductive wire satisfies the mathematics formula: $S=I/4\ mm^2$, wherein S represents a cross-sectional area of the high-frequency conductive wire, and I represents an operating current of the transformer.

15. The transformer according to claim 13, wherein the high-frequency conductive wire is made of multi-strand wire, and the high-frequency conductive wire satisfies the mathematics formula $d<152/(f)^{0.5}$ mm, wherein d represents a diameter of the multi-strand wire, and f represents an operating frequency of the transformer.

16. The transformer according to claim 1, further comprising:

a magnetic core having a core column;

wherein the first insulating portion of the primary coil unit forms a through hole, and the core column passes through the through hole, and the primary winding surrounds the core column.

17. A coil unit comprising:

a primary winding;

a first insulating portion wrapping and fixing the primary winding;

a shielding layer covering an outer surface of the first insulating portion and having an opening, a part of the first insulating portion being exposed at the opening;

an outgoing wire terminal provided in the opening and comprising a first portion and a second portion, wherein the first portion and the second portion are connected to each other, the first portion is coupled to the primary winding and is wrapped by the first insulating portion, and the second portion is exposed out of the first insulating portion;

a connecting wire having a first end connected to the second portion of the outgoing wire terminal;

an insulating sleeve wrapping the connecting wire, and a second end of the connecting wire being exposed out of the insulating sleeve; and an insulating retaining wall extending from the surface of the first insulating portion exposed at the opening to a position higher than an end of the insulating sleeve near the first insulating portion and surrounding the outgoing terminal and the insulating sleeve.

18. An electronic power apparatus, comprising a transformer according to claim 1.

19. A transformer comprising:

a primary coil unit comprising a primary winding, a first insulating portion and a shielding layer, wherein the first insulating portion is configured to wrap and fix the primary winding, the shielding layer covers an outer surface of the first insulating portion, the shielding layer includes an opening, and a part of the first insulating portion is exposed at the opening;

an outgoing wire terminal provided in the opening and having a first portion and a second portion, the first portion coupled to the primary winding and wrapped by the first insulating portion, and the second portion being exposed out of the first insulating portion, and the first portion and the second portion being connected with each other;

a connecting wire having a first end connected to the second portion of the outgoing wire terminal;

an insulating sleeve, partially wrapping the connecting wire, and a second end of the connecting wire being exposed out of the insulating sleeve, and an insulating retaining wall extending from the surface of the first insulating portion exposed at the opening to a direction away from the opening and surrounding the outgoing wire terminal and the insulating sleeve, wherein a potting material potted into the insulating retaining wall forms a potting layer, the potting layer extends from a plane where the opening is provided to the direction of the insulating sleeve and wraps the second portion of the outgoing wire terminal and a part of the insulating sleeve, and the insulating sleeve extends out of the insulating retaining wall.

20. The transformer according to claim 19, wherein the potting layer comprises:

a lower insulating layer closely connected to the first insulating portion and extending to one end of the insulating sleeve close to the first insulating portion, wherein the lower insulating layer is configured to wrap the second portion of the outgoing wire terminal and a portion of the first end of the connecting wire being exposed out of the insulating sleeve; and an upper supporting layer closely connected to the lower insulating layer and wrapping a part of the insulating sleeve;

wherein a hardness of the upper supporting layer is greater than a hardness of the lower insulating layer.

21. The transformer according to claim 19, wherein the insulating sleeve further wraps the second portion of the outgoing terminal and is closely connected to the first insulating portion.

22. The transformer according to claim 19, wherein both the insulating sleeve and the connecting wire are flexible.

23. The transformer according to claim 19, wherein the insulating sleeve is closely attached to the connecting wire.

24. The transformer according to claim 19, wherein the insulating sleeve is an insulating tape or an insulating tube wrapping around a periphery of the connecting wire.

25. The transformer according to claim 19, wherein the first insulating portion is made of an epoxy resin, a silicon rubber or a polyurethane.

26. The transformer according to claim 21, wherein the first end of the connecting wire and the second portion of the outgoing wire terminal are connected by bolts or by solder joints.

27. The transformer according to claim 19, further comprising:

a magnetic core having a core column;

wherein the first insulating portion of the primary coil unit forms a through hole, and the core column passes through the through hole, and the primary winding surrounds the core column.

28. An electronic power apparatus, comprising a transformer according to claim 19.

29. A coil unit comprising:

a primary winding;

a first insulating portion wrapping and fixing the primary winding;

a shielding layer covering an outer surface of the first insulating portion and having an opening, a part of the first insulating portion being exposed at the opening;

an outgoing wire terminal provided in the opening and comprising a first portion and a second portion, wherein the first portion and the second portion are connected to each other, the first portion is coupled to the primary winding and is wrapped by the first insulating portion, and the second portion is exposed out of the first insulating portion;

a connecting wire having a first end connected to the second portion of the outgoing wire terminal;

an insulating sleeve wrapping the connecting wire, and a second end of the connecting wire being exposed out of the insulating sleeve; and an insulating retaining wall extending from the surface of the first insulating portion exposed at the opening to a direction away from the opening and surrounding the outgoing wire terminal and the insulating sleeve, wherein a potting material potted into the insulating retaining wall forms a potting layer, the potting layer extends from a plane where the opening is provided to the direction of the insulating sleeve and wraps the second portion of the outgoing wire terminal and a part of the insulating sleeve, and the insulating sleeve extends out of the insulating retaining wall.

* * * * *